United States Patent [19]

Tyer et al.

[11] 4,315,468

[45] Feb. 16, 1982

[54] CONTROL SYSTEM FOR A SINGLE AUGER STARVED-AIR COMBUSTOR

[75] Inventors: Robert C. Tyer, Baldwin, Fla.; Robert E. Fitch, Kent; Gordon H. Tucker, Enumclaw, both of Wash.

[73] Assignee: The Boeing Company, Seattle, Wash.

[21] Appl. No.: 148,374

[22] Filed: May 9, 1980

[51] Int. Cl.[3] ..... F23K 3/00

[52] U.S. Cl. ..... 110/101 CF; 110/190; 110/186; 110/267

[58] Field of Search ..... 110/185–187, 110/190, 101 CF, 203–205, 210–212, 248, 255, 276, 267, 101 CA

[56] References Cited

U.S. PATENT DOCUMENTS

| | | | |
|---|---|---|---|
| 1,312,352 | 8/1919 | Pinet et al. | 110/101 CF |
| 2,015,939 | 10/1935 | Justus | 110/101 CF |
| 2,118,651 | 5/1938 | Macchi | 110/101 CF |
| 2,176,009 | 10/1939 | Lange | 110/190 |
| 2,218,895 | 10/1940 | Selig, Jr. | 110/190 |
| 2,237,237 | 4/1941 | Scoggin et al. | 110/190 |
| 2,242,580 | 5/1941 | Foulds | 110/190 |
| 2,269,800 | 1/1942 | Wetzel | 110/190 |

*Primary Examiner*—Henry C. Yuen

*Attorney, Agent, or Firm*—Finnegan, Henderson, Farabow, Garrett & Dunner

[57] ABSTRACT

A control system for a starved-air combustor wherein a combustion chamber is divided into a plurality of combustion chamber zones with separate overfire and underfire airflows being individually provided for each zone. Fuel is fed to the combustor in selectable constant weight batches and the supply of underfire air is proportional to the rate at which an auger rotates to convey the fuel through the combustor. Overfire air is supplied to each combustion zone in an inverse relationship to the variance of a sensed temperature within the zone from a predetermined temperature.

8 Claims, 11 Drawing Figures

CHEMICALLY CORRECT
4000
3000
2000
1000
0
T-°F
OPERATING RANGE FOR COMBUSTOR
OPERATING RANGE FOR AFTERBURNER
-40
-20
0
20
40
60
EXCESS AIR %

A (M1)
NOMINAL MAXIMUM
B (M2)
C (M3)

16
14
12
10
8
6
4
2
0
TON / HR.
0
.2
.4
.6
.9
1.0
AUGER SPEED

SPLITTER VALVE CONTROL
COVER VALVE CONTROL
FEED CONTROL CIRCUIT
RELEASE VALVE CONTROL
AUGER POSITION SENSOR
R
ERROR
RESTORE
105
107
201
203
205
207
209
211
213
215
217
218
219
221
223
225
227
229
231
233
235
111
113
115
121
151
153

BIN FULL
COVER VALVE
SPLITTER VALVE
AUGER POSITION
RELEASE VALVE

CONTROL SYSTEM FOR A SINGLE AUGER STARVED-AIR COMBUSTOR

BACKGROUND OF THE INVENTION

In the last century, much of the world's energy needs have been fulfilled by hydrocarbon fuels which provided a convenient, plentiful, and inexpensive energy source. The current rising costs of such fuels and concerns over the adequacy of their supply in the future has made them a less desirable energy source and has led to an intense investigation of alternative sources of energy. The ideal alternative energy source is a fuel which is renewable, inexpensive, and plentiful, with examples of such fuels being the byproducts of wood, pulp, and paper mills, and household and commercial refuse.

The use of alternative energy sources is not problem-free, however, since there is a concern over the contents of the emissions from the combustion of such fuels as well as the environmental ramifications of acquiring and transporting the fuel and disposing of the residue of combustion.

One promising prior art device for using such alternative energy sources while maintaining a high degree of environmental quality is the starved-air combustor wherein the air supplied for combustion is controlled in order to control temperature conditions and the rates of combustion are controlled to consume the fuel entirely. Such starved-air combustors are capable of burning various types of fuel and producing significant amounts of heat which can be employed for any number of purposes including the production of process steam for use in manufacturing and in the generation of electricity.

Starved-air combustors, as previously known and operated, have not been entirely satisfactory in both entirely consuming the combustible elements of the fuel at high throughput while not producing noxious emissions. This problem results, in part, from the use of such starved-air combustors to burn a wide variety of fuels some of which may be non-homogeneous, e.g, household or commercial refuse. It has not been possible in the previously known starved-air combustors to tailor in a real time manner the combustion processes to the type of fuel being combusted in order to maximize the efficiency of the combustor while minimizing the generation of air pollutants. While the pollution problem can be solved to a degree by the utilization of scrubbers and other antipollution devices, such mechanisims are very expensive and their cost may militate against the use of alternative energy sources.

SUMMARY OF THE INVENTION

It is an object of the present invention to provide a starved-air combustor capable of efficiently utilizing many different types and quantities of fuel.

Another object of this invention is to provide a starved-air combustor which does not release noxious pollutants into the atmosphere.

Yet another object of this invention is to provide a starved-air combustor which is capable of combusting to a very high degree the percentage of all combustible material provided to it as fuel.

Still another object of this invention is to provide a starved-air combustor including a control system for selectively controlling the quantity of hot combustion gases produced thereby in accordance with the demand for heat produced by the starved air-combustor.

Yet another object of this invention is to provide a starved-air combustor wherein the combustion chamber is divided into a plurality of combustion zones and includes a control system which controls independently the injection of air into each of the combustion zones.

Another object of this invention is to provide a starved-air combustor wherein the air supplied to each combustion zone includes overfire air supplied above the fuel in the combustion zone and underfire air supplied beneath the fuel in the combustion zone and wherein the amount of overfire air supplied is dependent upon the temperature in the combustion zone and the amount of underfire air supplied is dependent upon the rate that fuel is being conveyed through the combustion chamber.

To achieve these objects, and in accordance with the purpose of the invention, as embodied and broadly described herein, the starved-air combustor comprises: a combustion chamber having an inlet end for receiving fuel, the combustion chamber for combusting the fuel to produce a quantity of heat (hot combustion gases) related to the rate of combustion; means for conveying the fuel through the combustion chamber at a variable rate; means for supplying a variable airflow to the combustion chamber; and means for controlling the rate of the conveying means and the quantity of air supplied by the supplying means to increase the quantity of hot combustion gases produced by the system responsive to an increase in the heat demand and to decrease the quantity of hot combustion gases produced by the system responsive to a decrease in the heat demand.

The accompanying drawings, which are incorporated in and constitute a part of this specification, illustrate an embodiment of the invention and, together with the description, serve to explain the principles of the invention.

DESCRIPTION OF THE PREFERRED EMBODIMENT

Figure 1:
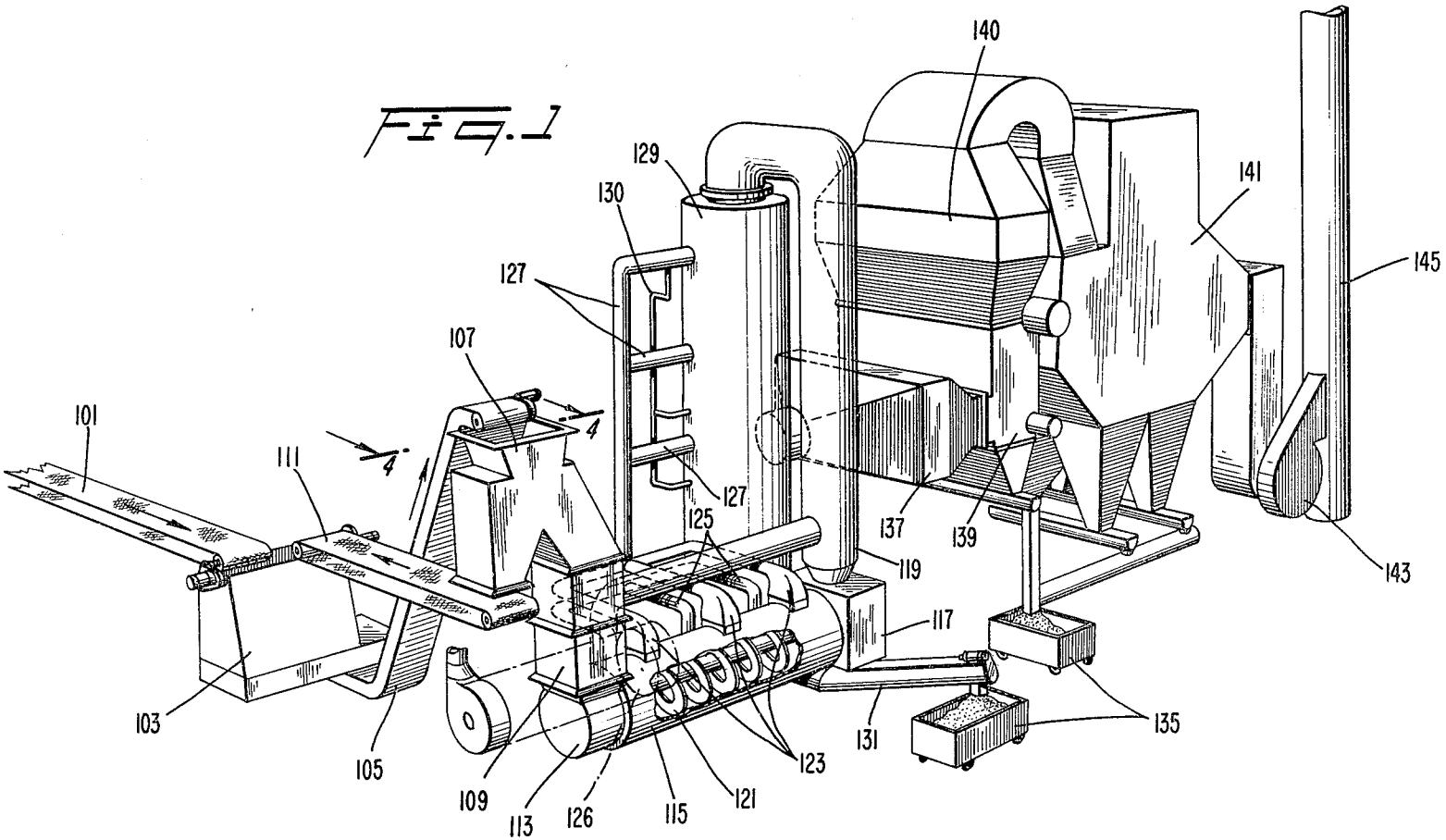
FIG. 1 is an illustration of the starved-air combustor system of the instant invention connected between a fuel supply system and a system which produces process steam from the heat produced by the starved-air combustor system.

FIG. 1 illustrates an embodiment of a starved-air combustor according to the present invention coupled between a refuse feeder system and a steam generation system. As embodied herein, the refuse supply comprises a supply conveyor 101 for conveying fuel, in this instance refuse, from a receiving building (not shown) and one or more storage silos (not shown). The receiving building and storage silos are to insure that an adequate supply of fuel can be supplied to the combustor in order to permit the combustor to run at peak efficiency. In the illustrated embodiment, it is contemplated that the supply conveyor 101 would supply fuel to the fuel surge and recirculation bin 103 at a rate of at least fifteen tons per hour and that the capacity of the combustor system would range from 150 to 500 pounds per minute.

The fuel surge and recirculation bin 103 comprises an additional means for insuring that a constant and adequate supply of fuel is available to the combustor. The bin 103 could, for example, contain at least 10 minutes capacity of fuel, i.e., approximately 25 tons, which is received at the top of the bin 103 and supplied through the bottom of the bin 103 to the feed conveyor 105. Feed conveyor 105 supplies the fuel to a splitter valve 107 which may either direct the fuel into the feed and weigh bin 109 or, when the feed and weigh bin 109 is filled to capacity, to the return conveyor 111 for return to the fuel surge and recirculation bin 103. The feed and weigh bin 109 is calibrated to supply a constant weight of fuel at the inlet end 113 of a refractory lined combustor 115 at such time that the first flight of an auger 121 within the chamber 115 has been rotated into a fuel-receiving position. Within the starved-air combustor 115 there is provided a well-known oil igniter (not shown) in the input end 113 of the combustion chamber 115 to serve as a means for initially igniting the fuel upon start up of the starved-air combustor.

U.S. Pat. No. 4,009,667 issued to Robert C. Tyer et al on Mar. 1, 1977, illustrates an appropriate embodiment for a rotatably-driven auger comprised of a rotatable, water-cooled horizontal shaft supporting a spiral flight of decreasing pitch from the input end of the auger to the output end. It is contemplated in the instant system that the speed of the auger would range from 0.3 to 1 rpm. An appropriate oil igniter would comprise an oil burner having its flame extending into the input end of the combustor 115 to heat and to ignite the initial load of fuel supplied by the feed and weigh bin 109. It is contemplated that such an oil igniter would be capable of burning oil fuel at a rate of approximately six gallons per hour at two pounds per square inch pressure.

The combustor 115 has an output end 117 connected to a conduit 119 which feeds the top of an afterburner 129. The combustor 115 also includes air supply means 123 for supplying underfire air and conduits 125 for supplying overfire air. This air is provided by a fan 126 (shown in phantom) which also supplies air through conduits 127 to the afterburner 129. Alternatively, a separate fan or fans may be provided to supply underfire, overfire air, and air to the afterburner 129. A small air distributor 130 is connected to the upper conduit 127 to supply air into the afterburner 129 through special injectors located both at and below the midpoint of the afterburner 129.

Afterburner 129 is provided, in part, as a secondary combustor chamber which mixes the air supplied by the conduits 127 with the gaseous and entrained solid particle output of the combustor from the outlet end 117 to combust all combustible material in the gaseous output and, in part, to separate suspended ash and non-combustible solids from the hot non-combustible gas. Both the non-combustible material from the afterburner 129 and the combustion residue from the combustor 115 are fed through conduit 131 to an ash collector 135. The hot non-combustible gas is discharged into a superheater 137 from which it is supplied to a waste heat boiler 139 to produce, in this case, process steam. An electrostatic precipitator 141 removes any additional solids from the now cooler non-combustible gas exiting from the waste heat boiler 139 through an economizer 140 and the solid material is conveyed to an ash cart 135. From the precipitator 141, the non-combustible gas is drawn by a fan 143 and expelled from stack 145. Upon entering into the fan the temperature of the gas is approximately 300 to 400 degrees Fahrenheit and the fan 143 is of sufficient strength to exert a negative pressure in the system within the combustor 115, the afterburner 129, superheater 137, waste heat boiler 139, economizer 140, and precipitator 141.

One of the principal advantages of a starved-air combustion system is that gasification or partial oxidation of solid fuels can be made to occur at moderate temperatures (1300°–1800° F.). The significant beneficial effects of this include elimination of slagging or fusing of the fuel and ash particles, exposing the combustor structure to only moderate temperature in non-oxidizing conditions, and reducing the formation of nitrogen oxides.

The principal control difficulty in the prior art starved-air combustor systems lies in maintaining temperature levels throughout the combustor, i.e., within the pile of fuel material and the gas space above it in the combustion chamber, while also optimizing the performance of the combustor system, i.e., mass of solid material gasified per unit of time and unit of area of grate surface. Temperature control is achieved by regulating the airflow into the combustion chamber to achieve the proper air/fuel ratio.

Figure 2:
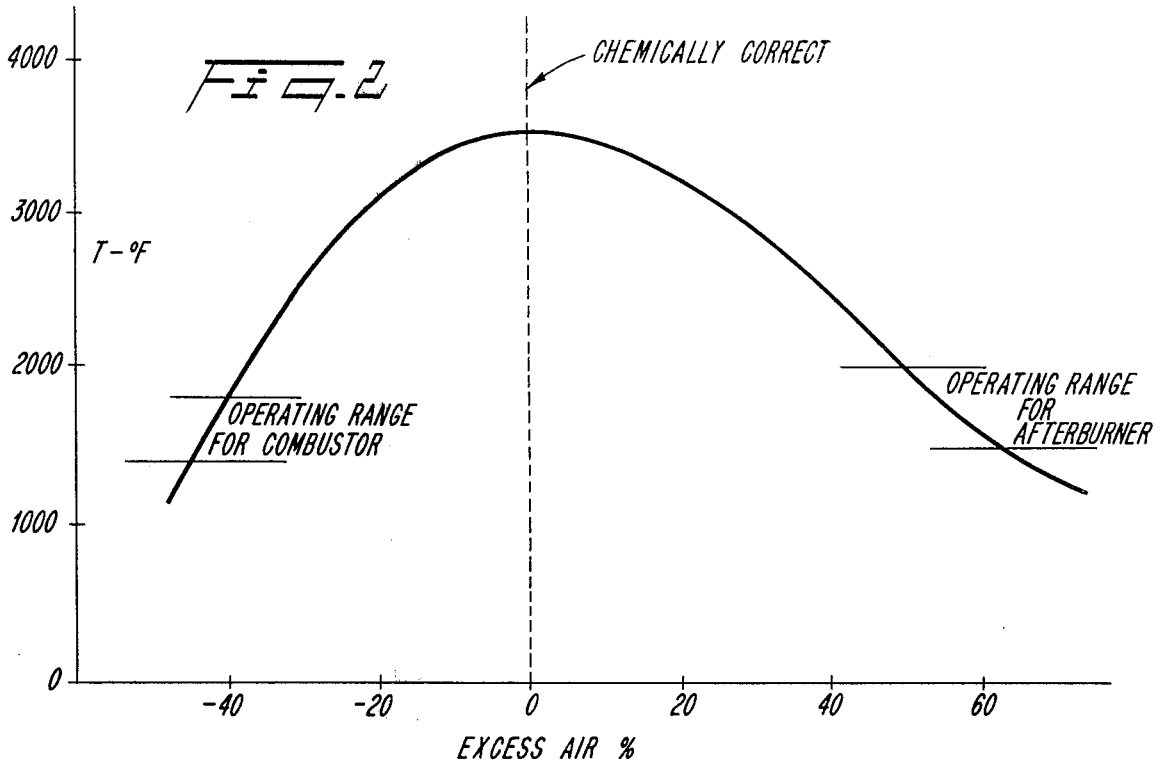
FIG. 2 is a graph illustrating the relationship between temperature in the combustion chamber and the afterburner of the starved-air combustor system as related to the amount of air supplied to the combustion chamber and to the afterburner.

FIG. 2 is a plot of temperature after reaction of fuel and air at different proportions and, as the terminology suggests, a starved-air combustor chamber operates at a negative percentage of excess air compared to the chemically correct amount in the temperature region indicated in FIG. 2. Thus, to increase the operating temperature within the combustion chamber of a starved-air combustor, it is necessary to increase the airflow into the combustion chamber.

Also evident from FIG. 2 is that the temperature within the afterburner responds to an increased airflow in the opposite manner as does the combustion chamber. Thus, to increase the temperature in the afterburner it is necessary to reduce the air supply thereto.

One problem in regulating the temperature within the combustion chamber is that the fuel bed and the injection of air into it are not necessarily homogeneous and the schedule of events leading to complete gasification or oxidation is not uniformly identical for all particles of the fuel. Local air/fuel ratio increases from average can cause radical temperature increases within the combustion chambers. Some of these pertubations in temperature are unavoidable because, as will hereinafter be explained, the air is injected into the combustion chamber from discrete parts through the refractory lining of the chamber and the fuel particles are obviously discrete solid particles thereby causing non-homogeneous air/fuel mixtures where the injected air directly impacts upon the fuel particles. These conditions are only temporary, however, because the auger within the combustion chamber removes and tumbles fuel so that the non-homogeneous conditions do not last long enough to cause slagging of the non-combustible material. The major difficulty arises in correctly relating the volumes the underfire air (the air supplied beneath the fuel in the combustion chamber) and the overfire air, (air supplied above the fuel in the combustion chamber) used in partially combusting or gasifying the solid fuel and the fuel gas to the rate of fuel flow within the combustion chamber.

The prior art attempted to solve the slagging and temperature control problems by different types of control systems. One type of control system is illustrated in the above-mentioned Tyer et al patent wherein the underfire air was uniformly supplied beneath the bed of fuel in the combustion chamber and the overfire air was supplied in multiple zones above the fuel bed. No means was provided for regulating the amount of fuel fed to the combustion chamber and all of the controls of the underfire air and the overfire air were manual. Some of the drawbacks of this arrangement were that it did not provide for altered zoning of the underfire air to accommodate changes in fuel moisture content and reactivity, and the possibility that uncontrolled variable fuel feed could lead to undesired oscillations in the operating properties in the combustion chamber.

It has also been attempted, in the prior art, to provide a combustion chamber wherein no overfire air is provided but where the underfire air was separated into three different zones with independent control of the airflow into each zone. This approach suffers from the inability to balance properly the reaction sequence in the fuel bed and the reaction sequence in the evolved combustion gases especially during changes of fuel feed rate. When the fuel feed was interrupted temporarily or when the rate of fuel feed was decreased because of a reduction of fuel density, the severe local temperature aberrations occurred because of an increase in the air/fuel ratio. When the airflow rate was decreased, the gasification rate and efficiency of the starved-air combustor decreased.

The present invention, as will hereinafter be described, avoids the problems of the prior art starved-air combustor systems and provides a starved-air combustor of greater efficiency by providing a feed system for feeding fuel into the combustion chamber in constant weight batches, an air supply system for feeding both underfire and overfire air in a zoned manner, and a control system for regulating underfire airflow in accordance with the rate of fuel flow through the combustion chamber and overfire airflow in accordance with the temperatures in the combustion zones. The feed system charges a fixed (operator-set) weight of fuel (M) for each rotation or partial rotation of the auger within the combustion chamber. This means that the fuel weight flow rate ($m_f$) is adjusted by changing the auger rotation rate ($W_{aug}$). The proportion of underfire air ($m_u$) to fuel weight flow rate is operator-set, as a function of auger rotation rate $W_{aug}$, while overfire flow rates ($m_o$) are controlled according to the gas temperature of the combustion zones $T_i$. Thus, fuel flow and underfire air are keyed to the auger's speed by $m_u = K \cdot M \cdot W_{aug}$ so that after M and the constants for each zone $K_i$ are set, then underfire air/fuel flow ratios are constant. If auger speed drops, $m_u$ is automatically decreased in proportion. Similarly, if M is decreased, $m_u$ is also decreased. Thus, the response of the starved-air combustor system to changes in heat demand is through auger speed.

This approach insures that the flow of fuel through the fuel bed in the combustion chamber is of uniform size and is provided with the same air/fuel ratio for each batch of fuel that is fed into the combustion chamber.

Figure 3:
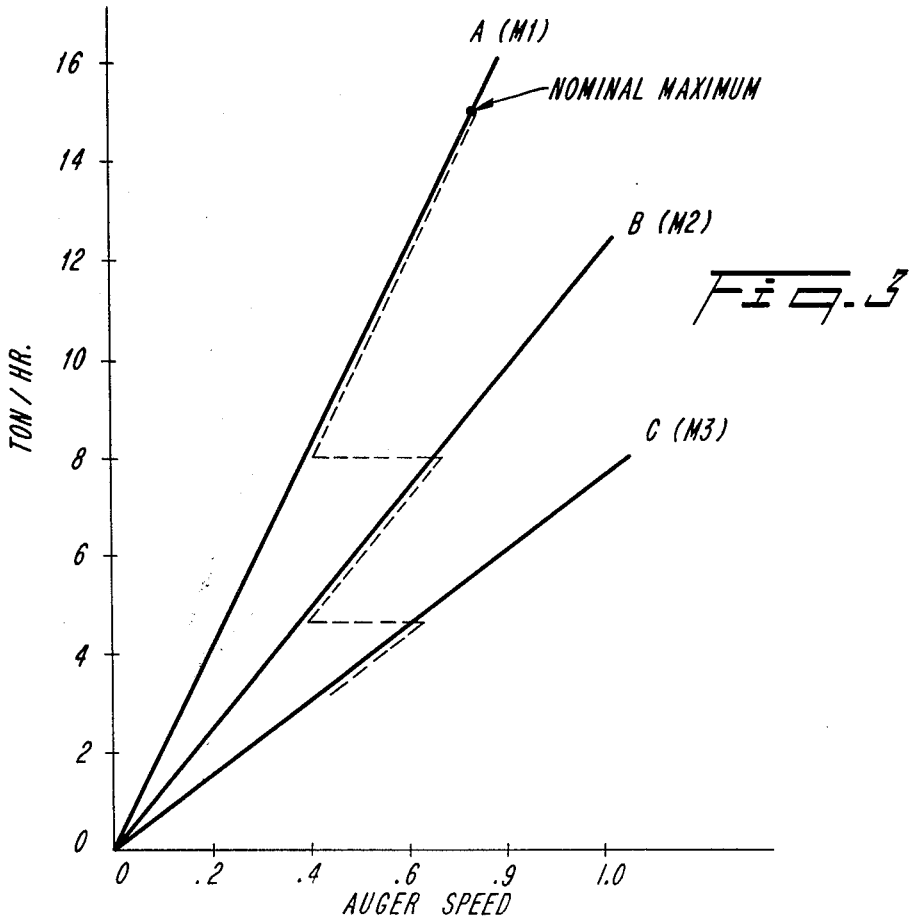
FIG. 3 is a graph illustrating the control of the fuel flow for three given weights of fuel and a range of auger rotation rate.

FIG. 3 is a graph relating fuel feed rates to auger speed. If, for example, the nominal maximum fuel feed rate and auger speed is 15 tons of fuel per minute and 0.9 revolutions of the auger per minute, then the line A relates decreases in the fuel feed rate to decreases in the auger speed for a constant fuel batch weight M1. It has been determined that if the auger is rotated at too slow a rate, e.g., less than 0.4 rpm, clinkering and slagging may occur within the combustion chamber. Thus, as the auger speed approaches 0.4 rpm with the fuel batch weight of M1, or the fuel feed rate is 8 tons per hour or less, then it is more efficient to operate along performance curve B with a fuel batch weight of M2 less than M1 than performance curve A. Similarly, a change to operating curve C with a fuel batch weight of M3 less than M2 should be effected when fuel is being fed at a rate of 5 or fewer tons per hour or auger speed approaches 0.4 rpm.

Figure 4:
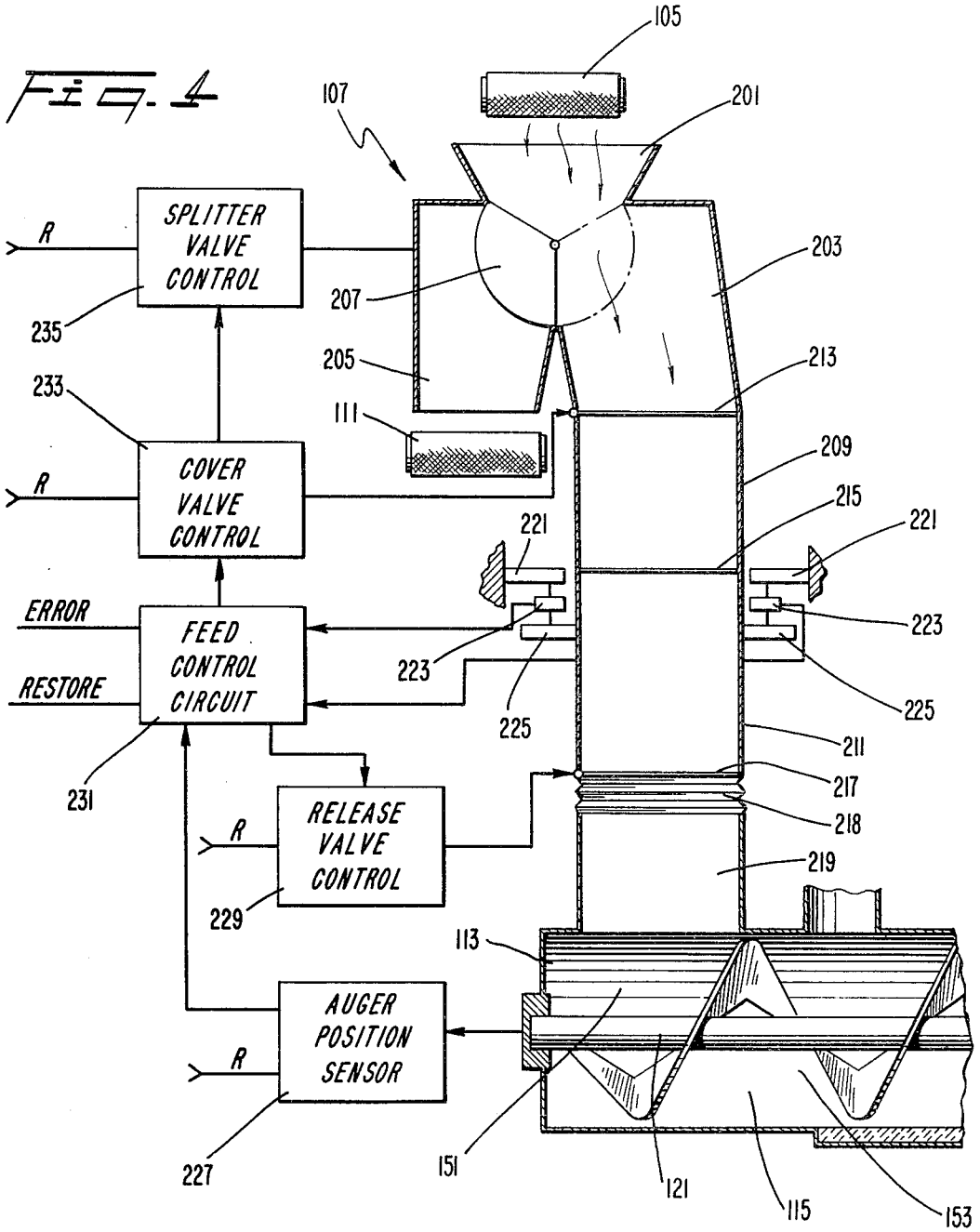
FIG. 4 is a cross-sectional view taken along lines 4—4 of a means for feeding variable quantities of fuel to the combustion chamber in a batch mode illustrated in FIG. 1.

As stated above, the starved-air combustor system of the instant invention includes means for feeding selectable weights of fuel into the inlet end 113 of the combustion chamber 115 in a batch mode. Such a feeding means is illustrated in FIG. 4. The feeding means comprises a chute 201 positioned beneath the fuel feed conveyor 105 such that fuel conveyed by the conveyor 105 drops off into the chute 201. From the chute 201, the fuel can either pass into a combustor feed path 203 of the feeding means or a return path 205 to the return conveyor 111 for return to the surge an recirculation bin 103 as previously explained. A splitter valve 207 is rotatable in the neck of the chute 201 to guide the received fuel to the combustor feed path 203 or to the return path 205.

The combustor feed path 205 leads to a chute 209 for guiding the fuel directed to the combustion chamber 115 into a weigh bin 211. A cover valve 213 is provided at the inlet of the chute 209 and is rotatable to either permit the fuel to pass from the chute 209 and into weigh bin 211 when the cover valve is in an open or downward position or to prevent additional fuel from entering chute 209 and weigh bin 211 when the cover valve 213 is in a closed or, as illustrated in FIG. 4, a horizontal position. The cover valve 213 provides an airtight seal with the sides of the chute 209 such that when the cover valve 213 is closed, outside air is prevented from entering chute 209 and weigh bin 211. The cover valve 213 could alternatively be a slidable valve having an inward (closed) position and an outward (open) position.

The weigh bin 211 is connected to the chute 209 via a flexible coupling 215 so that the weight of the weigh bin 211 and any fuel contained therein is not supported by the chute 209 but, as will hereinafter be explained, is supported by means of one or more weigh cells 223 connected between a stationary support member 221 and support arms 225 extending from the exterior of the weigh bin 211.

Release valve 217 is not opened, i.e, rotated to extend into the lower chute portion 219 of the feeding means, until the weigh cells 223 indicate that a predetermined weight of fuel has been accumulated in weigh bin 211 and an auger position sensor 227 has determined that the auger 221 has been rotated into the proper feed orientation. The lower chute portion 229 is coupled to the weigh bin 211 by means of a flexible, airtight seal 218 so as not to support the weigh bin 211 but merely to guide the fuel into the inlet end 113 of the combustion chamber 115 while simultaneously preventing ambient air from entering the combustion chamber 115. As stated above, the feeding means includes weighing means which, as embodied herein, comprise one or more weigh cells 223 coupled, as above-described, between stationary support members 221 and support arms 225 connected to the weigh bin 211.

One skilled in the art will readily recognize that each weigh cell 223 comprises any one of a number of means whereby a particular weight can be selected, the weight of the weigh bin including fuel received and contained therein determined, and an output signal generated when the measured weight of the weigh bin exceeds a selected weight. As an example, the weigh cell 223 could comprise a variable resistor for generating a voltage signal with a level proportional to the weight of the fuel in the bin 211. A voltage threshold detector senses the voltage levels and actuates a microswitch when the sensed voltage exceeds a threshold voltage corresponding to a selected weight. The output of the microswitch is employed within suitable logic circuitry, as will be hereinafter explained, to actuate splitter valve 207, cover valve 213, and release valve 217 to feed the conveyor with fuel in a proper manner.

Figure 5:
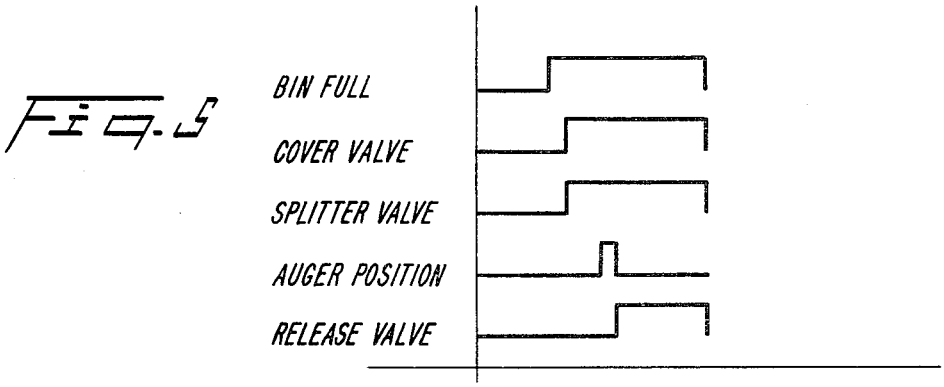
FIG. 5 is a timing diagram explaining the operation of the feeding means of FIG. 4.

FIG. 4 also illustrates, in block diagram form, functional logic circuits that are needed to control the feeding means to feed fuel either into the combustor 115 or to the return conveyor 111. FIG. 5 is a timing diagram to be read in conjunction with the block diagram of FIG. 4 for complete understanding of the operation of the logic circuits.

In normal operation, during the combustion chamber feed mode, the splitter valve 207 will be positioned as indicated by the solid lines in FIG. 4. The cover valve 213 will be in its open, or downward position, and the release valve 217 will be in the closed position as shown in FIG. 4. Fuel will be dropping from feed conveyor 105 through the feed path 203 and the upper chute 209 into the weigh bin 211. This will gradually cause an increase in the weight of the fuel in the weigh bin 211 and, when the preselected weight of a batch or charge of fuel has been accumulated in the weigh bin 211, then the weigh cells 223 will cause bin full signals to be supplied to the feed control circuit 231. This is illustrated in FIG. 5 as a change of the bin full signal from a low value to a high value.

When the preselected weight has been accumulated in the weigh bin 211, it is necessary to rotate the splitter valve 207 into the orientation shown by the dotted lines in FIG. 4 and to close the cover valve 213. This is performed under the control feed control circuit 231 by supplying an appropriate output to cover valve control 223 and to splitter valve control 235. Once the splitter valve 207 has been rotated into its recirculation position and the cover valve 213 rotated into its air-sealing position, then the feeding means will not change state until the auger position sensor 227 determines that the auger 121 has been rotated into an orientation such that the area 151 is of its proper feed volume. When this orientation of the auger 121 is reached, the auger position sensor 227 supplies a pulse as shown in FIG. 5, to the feed control circuit 231.

There are many ways of implementing the auger position sensor 227, for example, a small magnetic flux producing element could be attached to the auger such that it would be rotated into alignment with a flux sensor when the auger has been rotated into the feed orientation. When the feed control circuit has received the auger position pulse and is also still receiving the bin full signal at a high level, the feed control circuit 231 will signal the release valve control 227 to rotate the release valve 217 to its downward orientation in order to permit the fuel contained within the weigh bin 211 to pass through lower chute 219 into the first area 151 of combustion chamber 115.

The feed control circuit 231 will produce a restore pulse, after a suitable delay to provide time for the fuel to be discharged from the weigh bin 211, that is supplied to the auger position sensor 227, release valve control 229, cover valve control 233, and splitter valve control 235 to control the feeding means in a manner to permit the accumulation of a subsequent charge or batch of fuel in the weigh bin 211. As explained above, this feeding orientation comprises: first, closing release valve 217; second, opening the cover valve 213; and third, rotating splitter valve 207 into the orientation illustrated by the solid lines in FIG. 4. The weigh cells 223 will automatically reset the microswitch because after the discharge of the fuel from weigh bin 211 the weigh cells 223 will no longer indicate that a preselected fuel weight has been accumulated in weigh bin 211.

Figure 6:
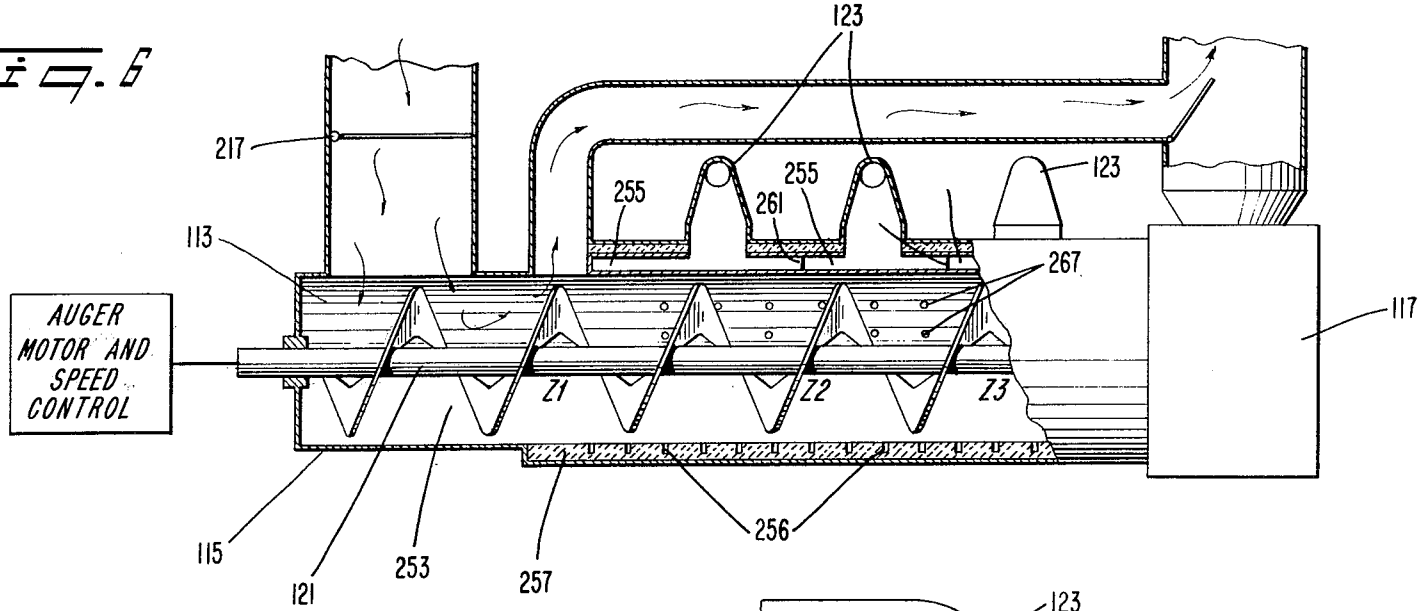
FIG. 6 is a longitudinal cross-sectional view of the combustion chamber of the starved-air combustor system of FIG. 1 taken along the line 6—6.

FIG. 6 illustrates an embodiment of the combustion chamber 115 of the starved-air combustor system. As shown in FIG. 6, the starved-air combustor system includes means for conveying the fuel through a combustion chamber at a variable rate. As embodied herein, the conveying means comprises screw conveyor or auger 121 extending the length of the combustion chamber and being rotated by the auger motor and speed control 251. The auger motor and speed control 251 is capable of rotating the auger at rates of, for example, from 0.3 to 1.0 rpm under manual control.

The fuel bed 253 is of its greatest depth at the inlet end 113 of the combustion chamber and is conveyed from the inlet end 113 to the outlet end 117. During its travel through the combustion chamber, the fuel bed 253 gradually decreases in size as its contents are combusted and combustion gases evolved. The auger 121 is positioned off-center within the combustion chamber 115 in order to provide a gas mixing zone above the fuel bed 253. In the mixing zone, the evolved gases are mixed with overfire air supplied by air supply means 125 (FIG. 1) for further combustion. Conduits 123 supply underfire air to the combustion chamber beneath the bed of fuel 253 such that the underfire air, when at an elevated temperature, contributes to the ignition of the fuel in the fuel bed 253 by heating and drying the fuel.

The starved-air combustor system further comprises means for supplying a variable airflow to the combustion chamber 115. The physical structure for accomplishing this is illustrated in FIG. 6 and, as embodied therein, the walls of the combustion chamber 115 include underfire air plenums 255 each coupled to one of the air supply conduits 123. Air passes from the plenums 255 through pipes 256 (FIG. 7) embedded in a refractory layer 257 and terminating in a plurality of ports or injectors 259 communicating with the combustion chamber 115 beneath the bed of fuel 253. The plenums 255 are separated from each other by stops or gaskets 261 to define multiple underfire combustion zones Z1, Z2, and Z3.

Similarly, overfire air is supplied to the combustion chamber 115 by means of plenums 263 (FIG. 7) communicating with the overfire air supply means 125. The plenums are divided into a plurality of zones (in this case, three) and the air within each zone is injected into the combustion chamber 115 through ports or injectors 267 which extend through the layer of refractory material 257 lining the interior surface of the combustion chamber 115. As illustrated in FIG. 6, the zones of the overfire air and the zones of the underfire air may coincide and form combustion zones Z1, Z2, and Z3. A temperature sensor 271 (FIG. 7) is inserted through the refractory material 257 into the gas phase flame areas of each of the temperature zones to sense the temperature in the overfire area of the zone.

Figure 7:
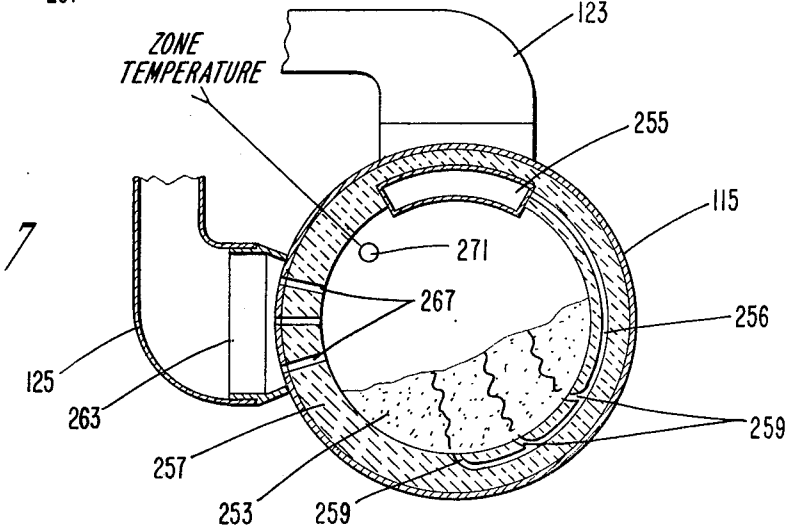
FIG. 7 is a transverse cross-sectional view of the combustion chamber of the starved-air combustor system of FIG. 1 taken along the lines 7—7.

With reference to FIG. 7, the rotation of the auger (not shown) within combustion chamber 115 results in the fuel bed 253 being oriented as shown. Underfire air from supply 123 is supplied to plenum 255 from which it is injected beneath the fuel bed 253 by means of pipes 256 terminating in injectors 259. The pipes 256 are embedded in the refractory lining 257 of the combustion chamber 115.

Underfire air received by one of the plenums 263 from supply 125 is injected above the fuel bed 253 through ports 267. The temperature sensor 271 for one of the overfire air zones is provided above the fuel bed 253 and it is contemplated that a thermocouple capable of withstanding the high combustion chamber temperatures could be employed as sensor 271.

Figure 8:
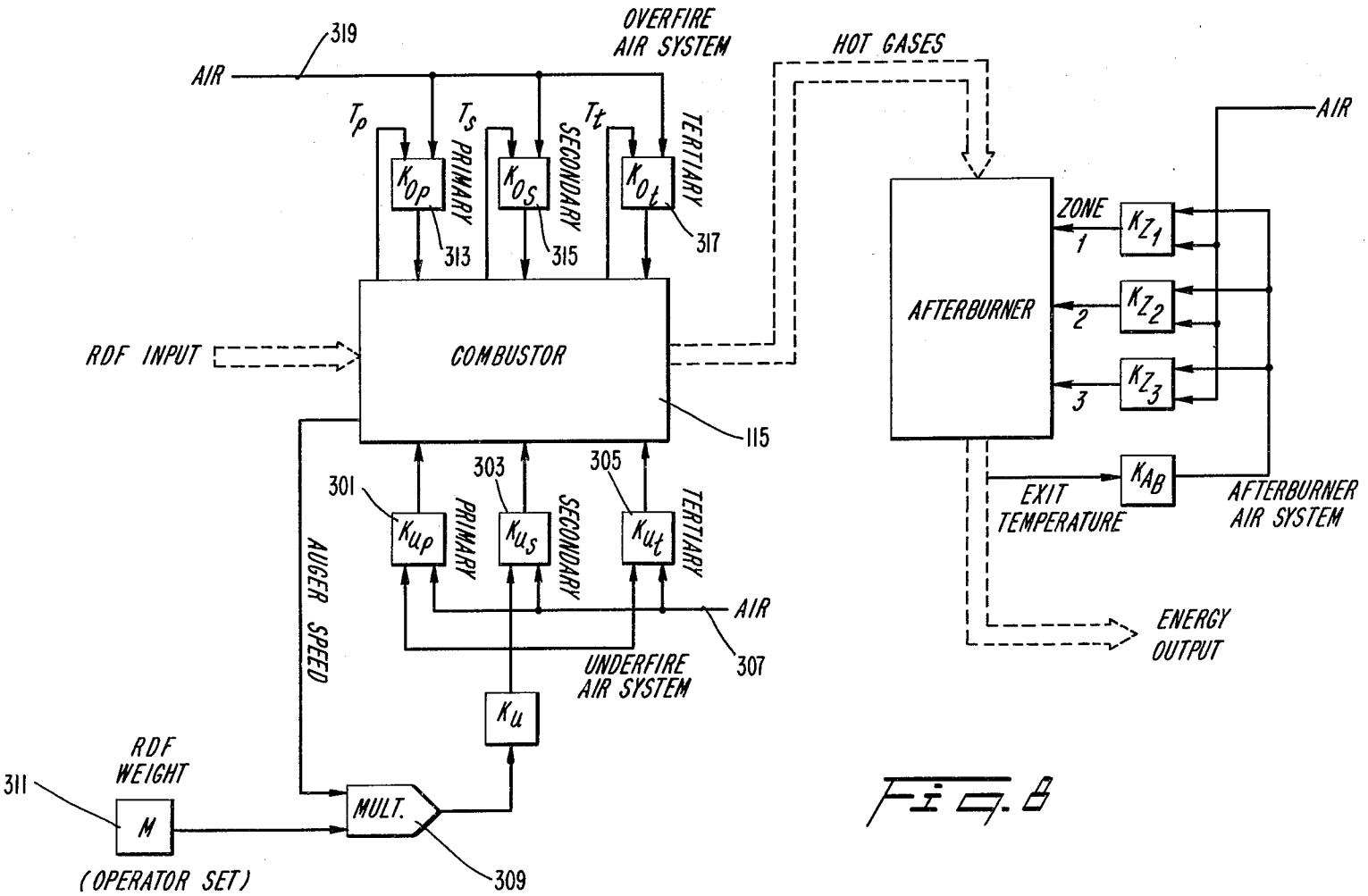
FIG. 8 is a schematic logic circuit diagram illustrating the control system for supplying overfire air and underfire air to the combustion chamber and air to the afterburner of the starved-air combustor system.

The starved-air combustor of the instant invention further comprises means for controlling the rate of the fuel conveying means or auger 121 and the volume of the airflow supplied into the zones Z1, Z2, and Z3 to increase or to decrease the quantity of heat produced in the form of hot combustion gases. The means for controlling the rate of the conveying means and the airflow supplied by the supplying means to increase the quantity of hot, combustion gases (heat) produced by the system responsive to an increase in the heat demand and to decrease the quantity of hot, combustion gases (heat) produced by the system responsive to a decrease in the heat demand, as embodied herein, is illustrated in FIG. 8 as comprising an underfire air system, an overfire air system, and an afterburner air system. The afterburner air system is not a feature of the present invention and will not be discussed in detail.

As illustrated in FIG. 8, the combustor 115 receives underfire air in three zones: primary (p) corresponding to Zone 1, secondary (s) corresponding to Zone 2, and tertiary (t) corresponding to Zone 3. Controllers 301, 303, and 305 control the injection of underfire air from air supply line 307 into the p, s, and t zones. These three zones are set to initial values to apportion the air supplied by the air supply line 307 to the previously discussed supplier 123 but, as explained above, if there is a change in heat demand then the speed of the auger will be changed necessitating corresponding changes in the supply of air to the p, s, and t zones by the controllers 301, 303, and 305, respectively. The change in auger speed as determined by the auger motor and speed control 251 (FIG. 6) are supplied to multiplier 309 along with a signal indicating the weight of each batch of fuel supplied to the combustion chamber. This weight is represented by the quantity M and could, for example, be an output of the previously explained weigh cells 223. The output of multiplier 309 is a signal $K_u$ which is supplied as an input to each of the controllers 301, 303, and 305 to alter the airflow into their associated underfire zones.

The overfire air system is, as previously explained, temperature dependent and thus the signal $T_p$ is an output of temperature sensor 271 (FIG. 7) which monitors the temperature in combustion zone Z1 or the primary zone. The controller 313 compares the instantaneous temperature within the primary zone to a desired temperature and properly alters the airflow from air supply line 319 to the primary zone in the combustion chamber. Similarly, controllers 315, and 317 receive the temperature indications $T_s$ and $T_t$, respectively, from the temperature sensors to 271 in their associated combustion zones. Any change in the temperatures in their associated zone from the desired temperature will cause the controllers 315 and 317 to alter the airflow from air supply line 319 into the secondary and tertiary zones in the manner illustrated in FIG. 2.

Figure 9:
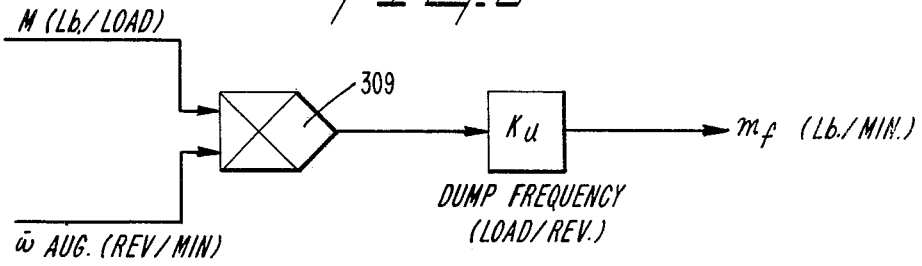
FIG. 9 schematically illustrates the logic of the control circuit for relating the angular rate of the auger to the quantity of fuel conveyed through the combustion chamber of the starved-air combustor system.

FIG. 9 illustrates, in greater detail, the circuit for controlling the flow of fuel into the combustor 115. The mass of each fuel batch or charge is supplied to the multiplier 309 where it is multiplied by the change in auger rotation rate $W_{aug}$. The output of the multiplier 309 is the change in fuel feed $m_f$ which must be accommodated by the underfire air control system.

Figure 10:
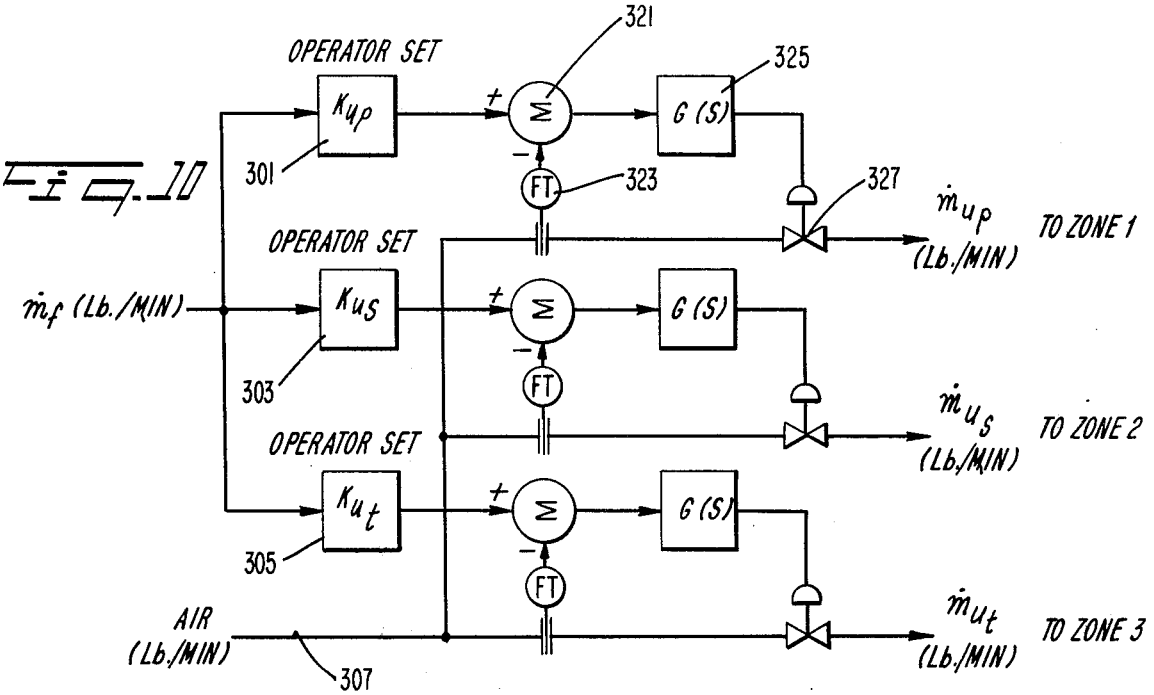
FIG. 10 schematically illustrates the control circuit for controlling the quantity of underfire air supplied to the combustion chamber of the starved-air combustor system.

FIG. 9 illustrates, in greater detail, the underfire air control system. The controllers 301, 303, and 305 are initially set with a constant indicating the air distribution into the primary, secondary, and tertiary zones. The controllers 301, 303, and 305 each receive, as an input, the change in fuel flow through the combustion chamber and each generate output signals to adjust accordingly the airflow into the primary, secondary, and tertiary zones. As an example, the output of controller 301 is a signal corresponding to the new airflow into the primary zone of the combustion chamber. This is supplied to an adder 321 which receives as its other input the output of flow transmitter 323 indicating the amount of air currently flowing into the primary zone from the air supply line 307. If there is a difference between the newly determined amount and the current airflow into the primary zone then a signal representing that difference is supplied to valve control circuit 325 to open or close a flow control device 327, e.g., a valve. The output of the flow control device 327 is the air supplied to the primary zone (Z1 in FIG. 6) through the appropriate air conduit 123 (FIG. 6). If the heat demand is increased, then the flow control device 327 will cause a greater airflow into the primary zone of the combustion chamber. Conversely, if the heat demand is decreased, the output of the adder 321 will be a negative difference and will cause valve control circuit 325 to control the flow control device 327 in a manner to restrict airflow into the primary zone of the combustion chamber. FIG. 10 also illustrates the circuits required to control airflow into the secondary and tertiary zones in the combustion chamber but these will not be explained since they operate in the same manner as the circuit for controlling airflow into the primary zone.

Figure 11:
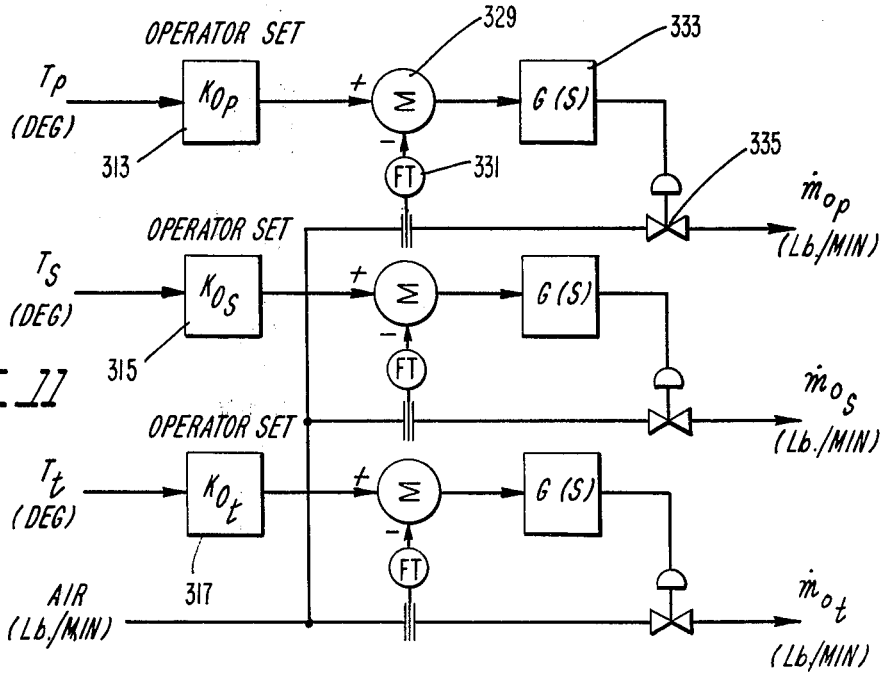
FIG. 11 schematically illustrates the control circuit for controlling the overfire air supply to the combustion zones in the combustion chamber of the starved-air combustor system.

FIG. 11 illustrates an embodiment of a circuit for controlling the flow of overfire air into the primary, secondary, and tertiary zones. Initially, the controllers 313, 315, and 317, are set to values corresponding to the desired temperature in the primary, secondary, and tertiary zones, respectively, within the combustion chamber. The controller 313, as explained above, receives a signal $T_p$ corresponding to the actual temperature within the primary zone and will generate an appropriate output signal representing the difference between the desired primary zone temperature and the actual primary zone temperature. This is supplied to the adder circuit 329 which receives as another input a signal corresponding to the current flow of overfire air into the primary zone. The difference between the two signals is determined and passed to valve control circuit 333 which appropriately opens or closes the flow control device, such as a valve 335, to either increase or to decrease the temperature within the primary zone. This will cause a change in the temperature in the primary zone which will be supplied to the controller 313. When the proper temperature has been reached in the primary zone, then the adding circuit 329 will no longer signal the valve control circuit 333 to adjust the flow control device 335.

Any number of embodiments for flow transmitters, summation circuits, valve control devices and flow control devices are known in the art and, one of ordinary skill in that art may select such devices according to the above teachings.

It will be further apparent to those skilled in the art, that numerous modifications and variations can be made to the feeding means of the starved-air combustor without departing from the scope or spirit of the invention and it is intended that the present invention cover the modifications and variations of the system, provided that they come within the scope of the appended claims and their equivalents.

What is claimed is:

1. A starved-air combustor system comprising:

a combustion chamber having an inlet end for receiving fuel, said combustion chamber for combusting said fuel, said combustion chamber being divided into a plurality of combustion zones;

means for conveying said fuel through said combustion to said combustion zones in said combustion chambers; and means responsive to the temperatures in said combustion zone for controlling said supply means to supply selected quantities of air to said combustion zones wherein said conveying means conveys said fuel through said combustion chamber at a selectively variable rate and wherein said controlling means controls said supplying means to increase the supply of said air to said combustion zones responsive to an increase in the rate of said conveying means and to decrease the supply of air to said combustion zones responsive to a decrease in said rate of said conveying means.

2. A starved-air combustor system for producing a variable quantity of heat responsive to a demand for said heat, said combustion system comprising:

a combustion chamber having an inlet end for receiving fuel, said combustion chamber for combusting said fuel to produce a quantity of heat related to the rate of combustion, said combustion chamber being divided into a plurality of combustion zones;

means for conveying fuel through said combustion chamber at a variable rate;

means for supplying a variable quantity of air to said combustion chamber, said supplying means comprising:

a set of overfire air injectors associated with each of said plurality of zones for injecting air above the fuel in said associated combustion chamber zone;

a temperature sensor associated with each of said combustion chamber zones for determining the temperature in said associated combustion zone; and an overfire air controller for controlling the quantity of air injected into each of said combustion zones by said associated set of overfire air injectors in response to the temperature in said associated zone as determined by said associated temperature sensor; and means for controlling the rate of said conveying means and the quantity of fuel supplied by said supplying means to increase the quantity of heat produced by said system responsive to an increase in said heat demand and to decrease the quantity of heat produced by said system responsive to a decrease in said heat demand.

3. A starved-air combustor system according to claim 2 further including means for feeding selectable weights of fuel into said inlet end of said conveyor in a batch mode.

4. A starved-air combustor system according to claim 3 wherein said combustion chamber is cylindrical and includes an outlet end for discharging combustion residue produced by said combustion and wherein said conveying means comprises:

a rotatable screw conveyor in said combustion chamber for conveying said constant weight batches of fuel from said inlet end of said combustion chamber to said outlet end of said combustion chamber and for conveying said combustion residue toward said outlet end of said combustion chamber; and means for rotating said rotatable screw conveyor at a variable rate directly proportional to said heat demand to control the flow of said fuel through said combustion chamber.

5. A starved-air combustor system according to claim 4 wherein said air supplying means further comprises:

a set of underfire air injectors associated with each said combustion chamber zone for injecting air into said associated zone beneath said fuel in said associated zone; and an underfire air controller for controlling the quantity of air injected into each of said associated zones by said set of underfire air injectors in direct proportion to said flow of fuel through said combustion chamber.

6. A starved-air combustor system for producing a variable quantity of heat responsive to a demand for said heat, said combustor system comprising:

a combustion chamber having an inlet end for receiving fuel, said combustion chamber for combusting said received fuel to produce hot combustion gases and combustion residue related to the rate of combustion of said fuel, said combustion chamber further having an outlet end for discharging said hot combustion gases, said combustion chamber being divided into a plurality of combustion zones serially spaced from said inlet end to said outlet end;

means for conveying said fuel in said combustion chamber from said inlet end toward said outlet end at a variable rate;

means for feeding selectable weights of said fuel into said inlet end in a batch mode;

a plurality of air injector means singularly associated with each of said combustion zones for independently supplying to said associated combustion zone a variable airflow; and means for controlling the rate of said conveying means and the airflow of each of said injector means to increase the quantity of heat produced by said system responsive to an increase in said heat demand and to decrease the quantity of heat produced by said system responsive to a decrease in said heat demand.

7. A starved-air combustor system according to claim 6 wherein each of said air injector means comprises:

a set of overfire air injectors for injecting air above the fuel in said associated combustion zone;

a temperature sensor associated with each of said combustion zones for determining the temperature in said associated combustion zone; and an overfire air controller for controlling the airflow of said set of overfire air injectors in an inverse relationship to changes in the temperature of said associated combustion zone.

8. A starved-air combustor system according to claim 7 wherein each of said plurality of air injector means further includes:

a set of underfire air injectors for injecting air into said associated combustion zone beneath the fuel in said associated combustion zone; and an underfire air controller for controlling the airflow of said set of underfire air injectors in direct proportion to the rate of conveyance of said fuel in said combustion chamber.

* * * * *